US011826009B2

(12) United States Patent
Williamson et al.

(10) Patent No.: US 11,826,009 B2
(45) Date of Patent: Nov. 28, 2023

(54) CLEANER HEAD FOR A VACUUM CLEANER

(71) Applicant: Dyson Technology Limited, Wiltshire (GB)

(72) Inventors: Heidi Williamson, Woking (GB); Thomas Clifford Carter, Bristol (GB); Ashley Alexandre Goncalves, Stourbridge (GB)

(73) Assignee: Dyson Technology Limited, Malmesbury (GB)

( * ) Notice: Subject to any disclaimer, the term of this patent is extended or adjusted under 35 U.S.C. 154(b) by 70 days.

(21) Appl. No.: 16/771,989

(22) PCT Filed: Dec. 11, 2018

(86) PCT No.: PCT/GB2018/053595

§ 371 (c)(1),
(2) Date: Jun. 11, 2020

(87) PCT Pub. No.: WO2019/116025

PCT Pub. Date: Jun. 20, 2019

(65) Prior Publication Data

US 2021/0137329 A1 May 13, 2021

(30) Foreign Application Priority Data

Dec. 12, 2017 (GB) ..... 1720704

(51) Int. Cl.

| | |
|---|---|
| ***A47L 9/04*** | (2006.01) |
| ***A47L 5/30*** | (2006.01) |
| ***A46B 13/00*** | (2006.01) |

(52) U.S. Cl.
CPC ..... *A47L 9/0477* (2013.01); *A46B 13/006* (2013.01); *A47L 5/30* (2013.01);
(Continued)

(58) Field of Classification Search
CPC .... A47L 9/0405; A47L 9/0411; A47L 9/0427; A47L 9/0444; A47L 9/0466;
(Continued)

(56) References Cited

U.S. PATENT DOCUMENTS

| | | | |
|---|---|---|---|
| 21,451 | A | 9/1858 | Shaler |
| 271,971 | A | 2/1883 | Batchelder |

(Continued)

FOREIGN PATENT DOCUMENTS

| | | | |
|---|---|---|---|
| CH | 168699 | A | 4/1934 |
| CH | 598423 | A5 | 4/1978 |

(Continued)

OTHER PUBLICATIONS

CN-205625807 WIPO Translation; De Wit, B; Oct. 12, 2016 (Year: 2016).*

(Continued)

*Primary Examiner* — Brian D Keller
*Assistant Examiner* — Sidney D Hohl
(74) *Attorney, Agent, or Firm* — Faegre Drinker Biddle & Reath LLP

(57) ABSTRACT

A cleaner head for a vacuum cleaner includes a single agitator rotatably mounted within a housing, the agitator being arranged transversely within the housing such that it is perpendicular to the direction of travel of the cleaner head during use, the agitator being conical in shape, such that a first end has a larger diameter than a second end.

14 Claims, 14 Drawing Sheets

(52) U.S. Cl.
CPC ..... *A47L 9/0411* (2013.01); *A47L 9/0444* (2013.01); *A46B 2200/3033* (2013.01)

(58) Field of Classification Search
CPC . A47L 9/0477; A47L 5/10; A47L 5/26; A47L 5/30; A47L 7/0066; A47L 11/18; A47L 11/32; A47L 11/4041; A47L 11/325; A47L 9/4041; A47L 5/20; A46B 2200/3033; A46B 13/02; A46B 13/006; B29L 2031/328; Y10S 134/90
USPC .... 15/179, 366, 383, 385, 389, 23, 32, 41.1, 15/50.3, 52.1, 373
See application file for complete search history.

(56) References Cited

U.S. PATENT DOCUMENTS

| | | | | |
|---|---|---|---|---|
| 1,889,224 | A | 6/1931 | Smellie | |
| 1,815,084 | A * | 7/1931 | White | A47L 9/0477 15/179 |
| 2,032,345 | A | 3/1936 | Callan | |
| 2,577,339 | A * | 12/1951 | Lee | B05C 17/0212 401/218 |
| 2,924,838 | A | 2/1960 | Jones | |
| 2,941,232 | A | 6/1960 | Clayton, Jr. | |
| 3,289,239 | A * | 12/1966 | Diebold | A47L 23/06 15/24 |
| 3,828,387 | A | 8/1974 | Liebscher | |
| 4,177,536 | A | 12/1979 | Powers | |
| 4,307,479 | A | 12/1981 | Mertes et al. | |
| 4,372,004 | A | 2/1983 | Vermillion | |
| 4,402,102 | A * | 9/1983 | Al-samman | B05C 17/0212 15/230.19 |
| 4,531,249 | A | 7/1985 | Sternberg | |
| 4,654,927 | A | 4/1987 | Novinger | |
| 5,193,243 | A | 3/1993 | Stegens | |
| 5,237,716 | A | 8/1993 | Lisec | |
| 6,122,798 | A | 9/2000 | Kobayashi et al. | |
| 6,125,495 | A | 10/2000 | Berg et al. | |
| 6,539,575 | B1 | 4/2003 | Cohen | |
| 8,601,643 | B2 | 12/2013 | Eriksson | |
| 9,414,728 | B2 | 8/2016 | Van Der Kooi et al. | |
| 9,648,999 | B2 | 5/2017 | Uphoff et al. | |
| 9,763,549 | B2 | 9/2017 | Hyun et al. | |
| 9,833,115 | B2 | 12/2017 | Eriksson | |
| 11,234,568 | B2 * | 2/2022 | Udy | A46B 13/006 |
| 2002/0060140 | A1 * | 5/2002 | Nakamura | H02K 7/14 198/788 |
| 2003/0066149 | A1 | 4/2003 | Stegens et al. | |
| 2004/0221418 | A1 * | 11/2004 | Nam | A47L 9/0444 15/389 |
| 2006/0272122 | A1 | 12/2006 | Butler et al. | |
| 2009/0229075 | A1 | 9/2009 | Eriksson | |
| 2010/0107357 | A1 * | 5/2010 | Odachi | A47L 9/0411 15/389 |
| 2010/0229330 | A1 | 9/2010 | Park et al. | |
| 2010/0306959 | A1 | 12/2010 | Follows et al. | |
| 2012/0011680 | A1 | 1/2012 | Owen et al. | |
| 2012/0297570 | A1 | 11/2012 | Fujita et al. | |
| 2013/0192024 | A1 | 8/2013 | Eriksson | |
| 2014/0165328 | A1 | 6/2014 | Jang et al. | |
| 2014/0331446 | A1 | 11/2014 | Eriksson | |
| 2015/0313431 | A1 | 11/2015 | Eriksson | |
| 2015/0327743 | A1 | 11/2015 | Van Der Kooi et al. | |
| 2016/0073841 | A1 | 3/2016 | Eriksson | |
| 2016/0166052 | A1 | 6/2016 | Kasper et al. | |
| 2017/0209008 | A1 | 7/2017 | Isley et al. | |
| 2018/0070785 | A1 | 3/2018 | Udy et al. | |
| 2018/0125315 | A1 | 5/2018 | Kasper, Jr. et al. | |
| 2018/0255991 | A1 | 9/2018 | Der Marderosian et al. | |
| 2018/0289226 | A1 | 10/2018 | De Wit | |
| 2021/0068602 | A1 | 3/2021 | Carter | |
| 2022/0079402 | A1 | 3/2022 | Isaacs | |
| 2022/0233038 | A1 | 7/2022 | Goncalves | |

FOREIGN PATENT DOCUMENTS

| | | | | |
|---|---|---|---|---|
| CN | 1387411 | A | 12/2002 | |
| CN | 1997309 | A | 7/2007 | |
| CN | 101984742 | A | 3/2011 | |
| CN | 102334949 | A | 2/2012 | |
| CN | 102462450 | A | 5/2012 | |
| CN | 102843946 | A | 12/2012 | |
| CN | 203676995 | U | 7/2014 | |
| CN | 203709941 | U | 7/2014 | |
| CN | 104395529 | A | 3/2015 | |
| CN | 204192514 | U | 3/2015 | |
| CN | 104703525 | A | 6/2015 | |
| CN | 104703526 | A | 6/2015 | |
| CN | 204600362 | U | 9/2015 | |
| CN | 105395133 | A | 3/2016 | |
| CN | 105592764 | A | 5/2016 | |
| CN | 105902239 | A | 8/2016 | |
| CN | 205625807 | U * | 10/2016 | A47L 9/04 |
| CN | 205625807 | U | 10/2016 | |
| CN | 206354985 | U | 7/2017 | |
| CN | 206596998 | U | 10/2017 | |
| CN | 108471917 | A | 8/2018 | |
| CN | 108937746 | A | 12/2018 | |
| DE | 7837324 | | 5/1980 | |
| DE | 202009001640 | U1 | 8/2010 | |
| EP | 3803223 | A3 | 9/1998 | |
| EP | 3289946 | | 3/2018 | |
| GB | 364362 | A | 1/1932 | |
| GB | 389743 | A | 3/1933 | |
| GB | 411801 | A | 6/1934 | |
| GB | 0513909 | | 10/1939 | |
| GB | 513909 | * | 10/1939 | A47L 11/4041 |
| GB | 516291 | A | 12/1939 | |
| GB | 535258 | A | 4/1941 | |
| GB | 690152 | A | 4/1953 | |
| GB | 1067851 | | 5/1967 | |
| GB | 1251690 | | 10/1971 | |
| GB | 2241430 | A | 9/1991 | |
| GB | 2518882 | | 4/2015 | |
| GB | 2543314 | A | 4/2017 | |
| GB | 2569313 | A | 6/2019 | |
| JP | 61-194470 | U | 12/1986 | |
| JP | 62-231610 | A | 10/1987 | |
| JP | H2-77219 | A | 3/1990 | |
| JP | 02-104322 | A | 4/1990 | |
| JP | H2-149239 | A | 6/1990 | |
| JP | H2-172430 | A | 7/1990 | |
| JP | 03-128046 | U | 12/1991 | |
| JP | H5-95866 | A | 4/1993 | |
| JP | H6-142018 | A | 5/1994 | |
| JP | H7-23884 | A | 1/1995 | |
| JP | H7-88062 | A | 4/1995 | |
| JP | H7-124085 | A | 5/1995 | |
| JP | H11-318781 | A | 11/1999 | |
| JP | 2004-222739 | A | 8/2004 | |
| JP | 2011-182874 | A | 9/2011 | |
| JP | 2012-005551 | A | 1/2012 | |
| JP | 1892377 | B2 | 3/2012 | |
| JP | 2015-192787 | | 11/2015 | |
| JP | 2016-510615 | A | 4/2016 | |
| JP | 2017-127640 | A | 7/2017 | |
| JP | 2018-075328 | A | 5/2018 | |
| WO | 2006/008983 | A1 | 1/2006 | |
| WO | 2014/140935 | A2 | 9/2014 | |
| WO | 2014/177171 | | 11/2014 | |
| WO | 2016/170853 | A1 | 10/2016 | |
| WO | 2017/064462 | A1 | 4/2017 | |
| WO | 2017/125704 | A1 | 7/2017 | |
| WO | 2019/115992 | A1 | 6/2019 | |

OTHER PUBLICATIONS

International Search Report and Written Opinion received for PCT Patent Application No. PCT/GB2020/050966, dated Jun. 24, 2020, 11 pages.

(56) References Cited

OTHER PUBLICATIONS

International Search Report and Written Opinion received for PCT Patent Application No. PCT/GB2020/050967, dated Jun. 24, 2020, 11 pages.
Notification of Reason(S) for Refusal received for Korean Patent Application No. 10-2020-7019768, dated Nov. 1, 2021, 8 pages.
Search Report Received for GB Application No. 1907852.6, dated Nov. 21, 2019, 1 page.
Search Report received for GB Application No. 1907853.4, dated Nov. 21, 2019, 1 page.
International Search Report and Written Opinion dated Jan. 30, 2019, directed to International Application No. PCT/GB2018/053595; 11 pages.
Search Report dated Jun. 6, 2018, directed to GB Application No. 1720704.4; 2 pages.
The First Office Action dated Mar. 2, 2021, directed to CN Application No. 201880080025.3; 18 pages.
Office Action received for Chinese Patent Application No. 202080040656 X, dated May 7, 2022, 19 pages (11 pages of English Translation and 8 pages of Office Action).
Office Action received for Chinese Patent Application No. 202080040739.9, dated May 25, 2022, 19 pages (11 pages of English Translation and 8 pages of Original Document).
Office Action received for Japanese Patent Application No. 2021-571805, dated Jan. 17, 2023, 6 pages (3 pages of English Translation and 3 pages of Original Document).
International Search Report and Written Opinion received for PCT Patent Application No. PCT/GB2018/053006, dated Dec. 20, 2018, 10 pages.
Office Action received for Japanese Patent Application No. 2021-571806, dated Jan. 24, 2023, 12 pages (6 pages of English Translation and 6 pages of Original Document).
Office Action received for Chinese Patent Application No. 202080040656.X, dated Jun. 27, 2023, 18 pages (11 pages of English Translation and 7 pages of Original Document).

* cited by examiner

CLEANER HEAD FOR A VACUUM CLEANER

REFERENCE TO RELATED APPLICATIONS

This application is a national stage application under 35 USC 371 of International Application No. PCT/GB2018/053595, filed Dec. 11, 2018, which claims the priority of United Kingdom Application No. 1720704.4, filed Dec. 12, 2017, the entire contents of each of which are incorporated herein by reference.

FIELD OF THE DISCLOSURE

The present invention relates to a cleaner head for a vacuum cleaner.

BACKGROUND OF THE DISCLOSURE

Cleaner heads for vacuum cleaners typically comprise an agitator for agitating debris located upon a surface, and a dirty air inlet through which agitated debris can pass.

During passage of agitated debris through the dirty air inlet, long strands of debris, for example hair or thread or the like, may become wrapped around the agitator or a mounting thereof. This may lead to an increased torque on the agitator, and a sufficient build-up of debris may lead to failure of the agitator, and hence a reduced pick-up performance.

SUMMARY OF THE DISCLOSURE

Accordingly, according to various aspects, the present invention provides a cleaner head for a vacuum cleaner, the cleaner head comprising a single agitator rotatably mounted within a housing, the agitator being arranged transversely within the housing such that it is perpendicular to the direction of travel of the cleaner head during use, the agitator being conical in shape, such that a first end has a larger diameter than a second end.

The conical agitator is advantageous because any debris which becomes wrapped around the agitator during use is encouraged by the conical shape to travel along the length of the agitator from the first end towards the second end where it can become lose and fall from the agitator. In use this debris which has travelled along the agitator can then be sucked into a vacuum cleaner to which the cleaner head is attached during use. The cleaner head has a single agitator. This is advantageous as it makes the cleaner head simpler and cheaper in construction. The cleaner head does not have a plurality of agitators.

As used herein the term "debris" is considered to refer to long strands of debris which have the potential to wrap around the agitator during operation of the cleaner head, unless otherwise stated. For example, debris may be considered to comprise debris having a length which is greater than the circumference of the agitator. Particular examples of such "debris" include hair and threads.

The agitator may have a core, preferably a hollow core. The core may have an outer conical surface. The lowermost portion of the conical surface may be parallel to a flat supporting surface when the cleaner head is in use. The axis of rotation of the agitator may be inclined with respect to a flat supporting surface on which the cleaner head is supported during use. This arrangement is advantageous as the agitator is the same distance from the surface to be cleaned, along its full length.

The agitator preferably extends transversely across substantially the full width of the housing. In a particular embodiment the housing may have a lower opening. The lower opening may conform in outline to the taper of the agitator. Alternatively the lower opening may be rectangular in shape.

In a particular embodiment the agitator may be cantilevered to the housing. This is advantageous as it means that there is a free end from which debris can fall from the agitator during use of the cleaner head. In a particular embodiment the agitator is cantilevered at its first end. In such an embodiment debris will travel from the larger diameter end of the agitator towards the smaller diameter end. It can then fall off the free end of the agitator and be sucked into a vacuum cleaner to which the cleaner head is attached during use.

The agitator may further comprise bristle tufts, bristle strips or a surface conforming material, for example a fleece or felt material. The bristle tufts, bristle strips or surface conforming material may be formed from any suitable material for example nylon or carbon fibre or a combination of materials. The bristle tufts, bristle strips or surface conforming material may project the same distance from the core along the full length of the agitator.

The agitator may be driven by a belt from a motor located outside of the agitator. Alternatively it may be driven by a motor located inside the agitator. Such an arrangement is advantageous as it makes the cleaner head more compact The cleaner head housing may also be substantially conical in shape. This is advantageous as it helps to keep the pressure inside the cleaner head correct.

The cleaner head housing may also further comprise a neck suitable for connection to a vacuum cleaner. The neck may be arranged such that it projects from the housing at a point between the first and second ends of the agitator. This is advantageous as it balances the cleaner head and provides a cleaner head which is easy to manoeuvre over a surface to be cleaned. In a particular embodiment the neck may project from the housing at a mid-point between the first and second ends of the agitator.

The present invention also provides a vacuum cleaner having a cleaner head as described above.

According to a second aspect there is provided a cleaner head for a vacuum cleaner, the cleaner head comprising an agitator rotatably mounted within a housing, wherein the agitator comprises a main body having a wall, and bristles mounted to the main body adjacent the wall, tips of the bristles are located at a first radial distance from a central longitudinal axis of the agitator, a tip of the wall is located at a second radial distance from the central longitudinal axis of the agitator, the bristles have a first configuration in which the first radial distance is greater than the second radial distance, and a second configuration in which the first radial distance is less than or equal to the second radial distance, and during rotation of the agitator within the housing in use the bristles flex from the first configuration to the second configuration when the bristles move into contact with a surface to be cleaned, and flex from the second configuration to the first configuration when the bristles move out of contact with the surface to be cleaned.

The cleaner head according to the second aspect may be advantageous principally as tips of the bristles are located at a first radial distance from a central longitudinal axis of the agitator, a tip of the wall is located at a second radial distance from the central longitudinal axis of the agitator, the bristles have a first configuration in which the first radial distance is greater than the second radial distance, and a second configuration in which the first radial distance is less than or equal to the second radial distance, and during rotation of the agitator within the housing in use the bristles flex from the first configuration to the second configuration when the bristles move into contact with a surface to be cleaned, and flex from the second configuration to the first configuration when the bristles move out of contact with the surface to be cleaned.

In particular, entanglement of debris with bristles can lead to debris wrapping around the agitator in use, and bristles are typically more densely packed, and hence more prone to entangle debris, at the base thereof. As the bristles have a second configuration in which the first radial distance is less than or equal to the second radial distance, a lower proportion of the length of the bristles may be exposed past the wall in the second configuration, and hence debris may be prevented from migrating toward the base of the bristles when bristles adopt the second configuration upon contact with a surface to be cleaned in use of the cleaner head. Furthermore, debris which would typically become entangled in the bristles, for example at the base of the bristles, may be contacted by the projection and prevented from reaching the base of the bristles, or moved out of contact with the bristles, for example outwardly to the level of the tip of the wall or to a less densely packed region of bristles, and may thereby prevent such entanglement from occurring. Engagement between the tip of the wall and the surface to be cleaned may move debris outwardly through the bristles to a region where the bristle density is insufficient to trap debris. Hence debris may not necessarily reach the level of the tip of the wall, but may still be prevented from becoming entangled in the bristles in use.

As used herein the term "debris" is considered to refer to long strands of debris which have the potential to wrap around the agitator during operation of the cleaner head, unless otherwise stated. For example, debris may be considered to comprise debris having a length which is greater than the circumference of the agitator.

The bristles may comprise flexible bristles, for example such that the bristles flex to move between the first and second configurations. This may be beneficial as the flexible nature of the bristles may enable the bristles to perform an agitating function on a floor surface to be cleaned in use. Rotation of the agitator may move the bristles between the first and second configurations, for example as a result of staged engagement/disengagement of the bristles with a surface to be cleaned in use.

The wall may comprise a rigid wall. This may be beneficial as this may ensure that the first distance is less than or equal to the second distance in the second configuration, for example by restricting deformation of the wall, and hence may ensure that entanglement of debris with the bristles is avoided. For example, the wall may be sufficiently rigid to prevent deformation of the wall such that the first radial distance is greater than the second radial distance in the second configuration. The wall may comprise a Shore A hardness of at least 40, at least 50, or at least 60.

The bristles may be sub-flush relative to the tip of the wall in the second configuration. For example, the first distance may be less than the second distance when the bristles are in the second configuration. This may be beneficial as it may allow the projection to move debris outwardly beyond the extent of the bristles, and hence may prevent entanglement from occurring.

The agitator may be substantially cylindrical in global form. The tip of the wall may comprise an end of the wall, for example a radially outermost point of the wall. The tip of the wall may also be referred to as a peak, apex, or radially outermost edge, or the like.

The wall may comprise a radially extending wall, for example a wall extending in a direction having a radial component. The tip of the wall may be located in a plane substantially orthogonal to the main body, for example in a plane substantially orthogonal to a tangential plane of the main body. The bristles may be spaced from the tip of the wall, for example spaced in a substantially circumferential direction of the agitator, in the first configuration. This may be beneficial as it may provide space for the bristles to move between the first and second configurations. The wall may be inclined relative to a radially extending plane of the agitator, for example a plane extending radially outwardly from a central longitudinal axis of the agitator. The bristles may move toward the tip of the wall when moving from the first configuration to the second configuration, and may move away from the tip of the wall when moving from the second configuration to the first configuration. The bristles may contact the wall in the second configuration.

The wall may comprise a region of increased distance from a central longitudinal axis of the agitator, for example increased radial distance, relative to the main body. The wall may comprise a projection or ridge formed on the main body, for example integrally formed on the main body. The wall may project radially outwardly from the main body of the agitator.

The main body may comprise a channel within which the bristles are mounted, and the wall may define, and/or lead into, a wall, for example a side wall, of the channel. This may be beneficial as the channel may allow for more secure mounting of the bristles to the agitator. The channel may be at least partly defined by regions of increased and/or decreased distance from a central longitudinal axis of the agitator relative to the main body, for example regions of increased and/or decreased radial distance. The channel may be at least partly defined by opposing projections formed on the main body, for example integrally formed on the main body. The channel may be at least partly defined by a recess formed in the main body.

The bristles may be provided longitudinally along the agitator, and the wall may extend longitudinally along the agitator to substantially the same longitudinal extent as the bristles. This may be beneficial as the wall may prevent entanglement of debris with the bristles along substantially the entirety of the longitudinal extent of the bristles.

The wall may be integrally formed with the agitator, for example with the main body of the agitator. This may be beneficial as it may provide a simple arrangement with few component parts, and may be cheaper and/or simpler to manufacture than an assembly requiring multiple component parts.

The bristles and/or the wall may extend helically about the agitator. This may be beneficial as this may result in staged engagement between debris and the wall along the length of the agitator during rotation of the agitator, which may result in migration of debris along the agitator by the wall.

The wall may migrate debris along the agitator through interaction between the wall and a surface to be cleaned in use, for example toward an end or the centre of the agitator. The wall may be configured to migrate debris, for example hair, toward a debris collection channel during rotation of the agitator within the housing in use. This may be beneficial as the debris collection channel may collect debris, for example hair, at a single point, which may enable easier removal of the debris by a user. The debris collection channel may be formed on the agitator, for example at an end or the centre thereof, or may be located adjacent an end of the agitator within the housing of the cleaner head in use. The debris collection channel may comprise a region of reduced diameter relative to the remainder of the main body of the agitator. This may be beneficial as it may enable debris to fall off the agitator into the debris collection channel in use. The debris collection channel may extend circumferentially about the agitator, for example for at least 90°, or for substantially 360°.

The cleaner head may comprise a debris removal mechanism located at the debris collection channel, which may, for example, be automatically or manually operable. This may be beneficial as it may enable removal of debris from the agitator in use. The debris removal mechanism may be mounted to the agitator, for example at an end thereof.

The agitator may comprise a recess for insertion of a debris removal tool, the recess may be located in the vicinity of the debris collection channel, and the recess may extend in a direction substantially parallel to a central longitudinal axis of the agitator. This may be beneficial as it may allow for easy removal of debris from the agitator by a user, for example by insertion of a debris removal tool into the recess in a direction along the length of the agitator.

The debris collection channel may be located at an end of the agitator, for example formed on an end of the agitator or located adjacent an end of the agitator within the cleaner head in use. This may be beneficial as it may enable easy removal of debris from the debris collection channel by a user. For example, an end cap of the housing may be removable in the vicinity of the debris collection channel to allow removal of debris from the debris collection channel by a user.

The debris collection channel may be located centrally along the agitator, for example at a mid-point of the agitator. This may be beneficial as it may reduce the distance debris has to travel before being collected in the debris collection channel, and may reduce the risk of debris becoming entangled as it travels along the agitator in use.

At least a portion of the agitator may be inclined toward the debris collection channel. This may be beneficial as it may promote migration of debris toward the debris collection channel. At least a portion of the agitator may be inclined toward the debris collection channel whilst at least a portion of the agitator is configured to lie parallel to a surface to be cleaned in use. This may be beneficial as it may ensure that debris is migrated along the agitator without interfering with the normal agitating function of the agitator in use. The at least a portion of the agitator may comprise an angle of inclination of at least 5°, or at least 10°, relative to a base of the agitator. The agitator may be substantially conical in form.

The agitator may comprise a further wall located on an opposite side of the bristles to the first wall, a tip of the further wall may be located at a third radial distance from the central longitudinal axis, and the third radial distance may be no greater than the second radial distance. This may be beneficial as this may inhibit debris from passing through the base of the bristles during rotation of the agitator, and hence may prevent debris from becoming entangled with the bristles and wrapping around the agitator, without interfering with the normal agitating function of the bristles. The third radial distance may be less than the second radial distance.

The further wall may extend longitudinally along the agitator to substantially the same longitudinal extent as the bristles. This may be beneficial as the further wall may prevent entanglement of debris with the bristles along substantially the entire longitudinal extent of the bristles.

The further wall may be integrally formed with the agitator. This may be beneficial as it may provide a simple arrangement with less component parts, and may be cheaper and/or simpler to manufacture than an assembly requiring multiple component parts.

The further wall may extend helically about the agitator. This may be beneficial as this may result in staged engagement between debris and the further wall along the length of the agitator during rotation of the agitator, which may result in migration of debris along the agitator by the further wall.

The wall may be located rearward of the bristles in a direction of rotation of the agitator within the cleaner head, for example such that the bristles contact a surface to be cleaned prior to the wall contacting the surface to be cleaned. This may be beneficial as it may enable the bristles to contact the surface to be cleaned to perform their desired agitating function before the wall acts to prevent any entanglement of debris with the bristles.

The further wall may be located forward of the bristles in a direction of rotation of the agitator, for example such that the further projection contacts a surface to be cleaned prior to the bristles and/or the projection. This may be beneficial as it may inhibit passage of debris to the base of the bristles, and hence may inhibit wrapping of debris around the agitator.

The agitator may be cantilevered within the housing, for example mounted to one end of the housing only, and the agitator may be configured to migrate debris toward a free end of the agitator. This may be beneficial as it may enable debris to pass-off the free end of the agitator in use and to be re-entrained within the flow of air through the housing, and hence removed from the agitator. This may allow for automatic removal of debris from the agitator without the need for user interaction.

The agitator may comprise first and second agitator portions, each of which is cantilevered within the housing, such that respective ends of the agitator portions are freely supported within the housing. This may be beneficial as it may enable debris to migrate along and off the agitator portions and to be re-entrained within the flow of air through the housing, and hence removed from the agitator. This may allow for automatic removal of debris from the agitator without the need for user interaction.

According to a third aspect there is provided an agitator for a cleaner head of a vacuum cleaner, the agitator comprising a main body having a wall, and bristles mounted to the main body adjacent the wall, wherein tips of the bristles are located at a first radial distance from a central longitudinal axis of the agitator, a tip of the wall is located at a second radial distance from the central longitudinal axis of the agitator, the bristles have a first configuration in which the first radial distance is greater than the second radial distance, and a second configuration in which the first radial distance is less than or equal to the second radial distance.

According to a fourth aspect there is provided a vacuum cleaner comprising the cleaner head of the second aspect, and/or an agitator according to the third aspect.

Preferential features of aspects of the present invention may be applied equally to other aspects of the present invention, where appropriate.

BRIEF DESCRIPTION OF THE FIGURES

In order to better understand the present invention, and to show more clearly how the invention may be put into effect, the invention will now be described, by way of example, with reference to the following drawings.

DETAILED DESCRIPTION OF THE DISCLOSURE

Figure 1:
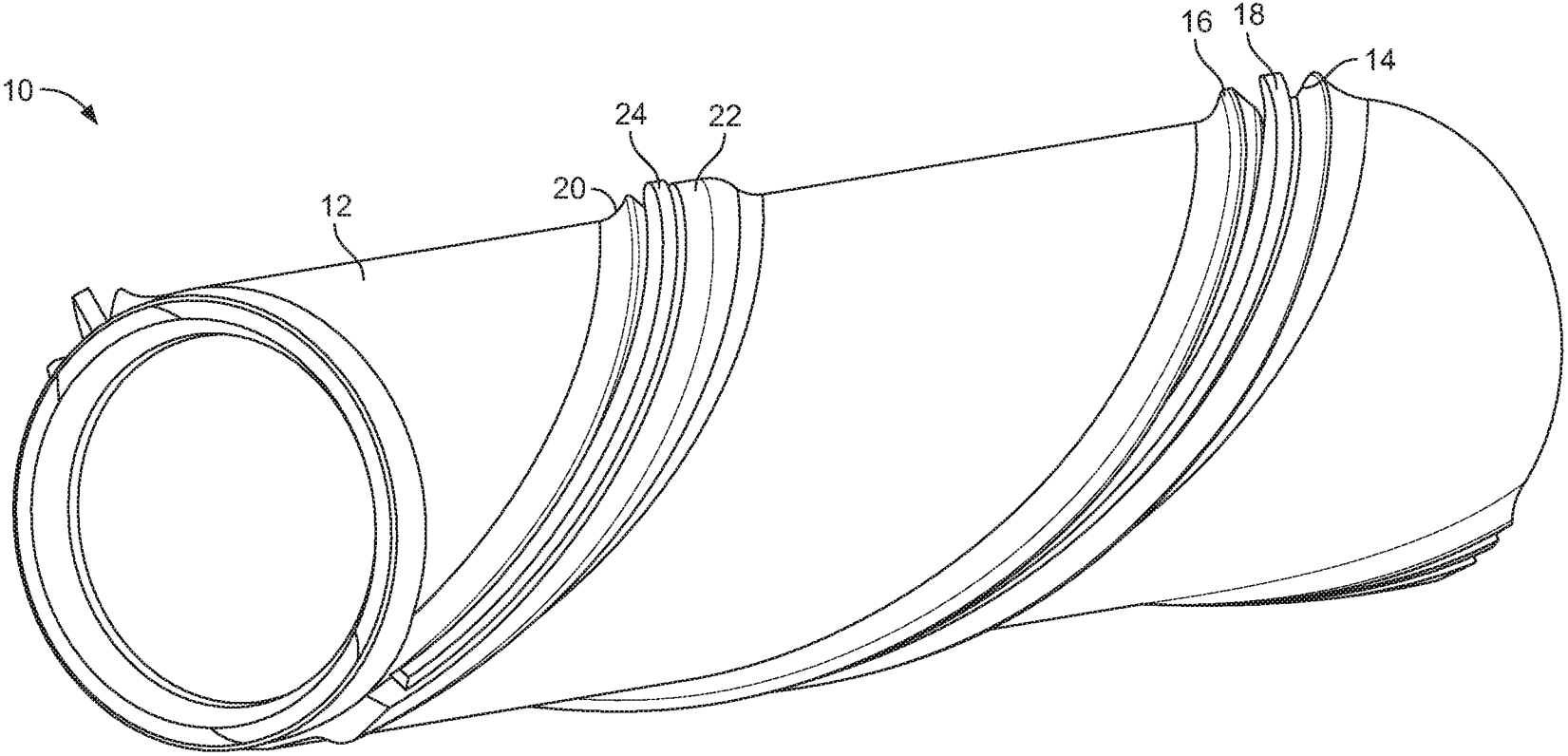
FIG. 1 is a perspective view of an agitator.

A first embodiment of an agitator, generally designated 10, is shown in FIGS. 1 to 6.

The agitator 10 takes the form of a brushbar, and these terms will be used interchangeably hereafter. The brushbar 10 comprises a main body 12, first 14 and second 16 projections (i.e., walls), a first bristle strip 18, first 20 and second 22 raised portions, and a second bristle strip 24.

Figure 2:
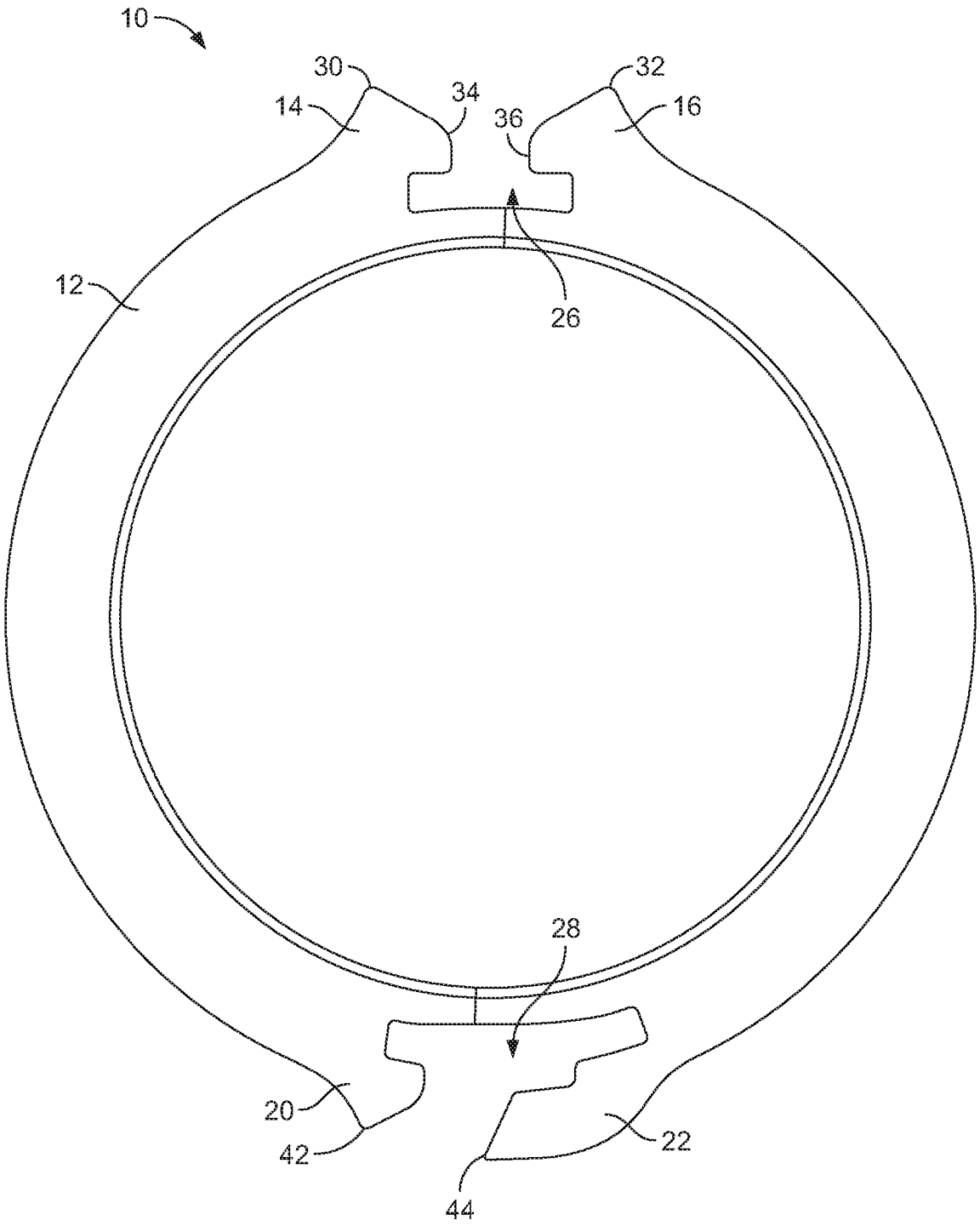
FIG. 2 is a schematic sectional view of the agitator of FIG. 1 taken transversely to a longitudinal axis of the agitator, with bristle strips removed.
Figure 3:
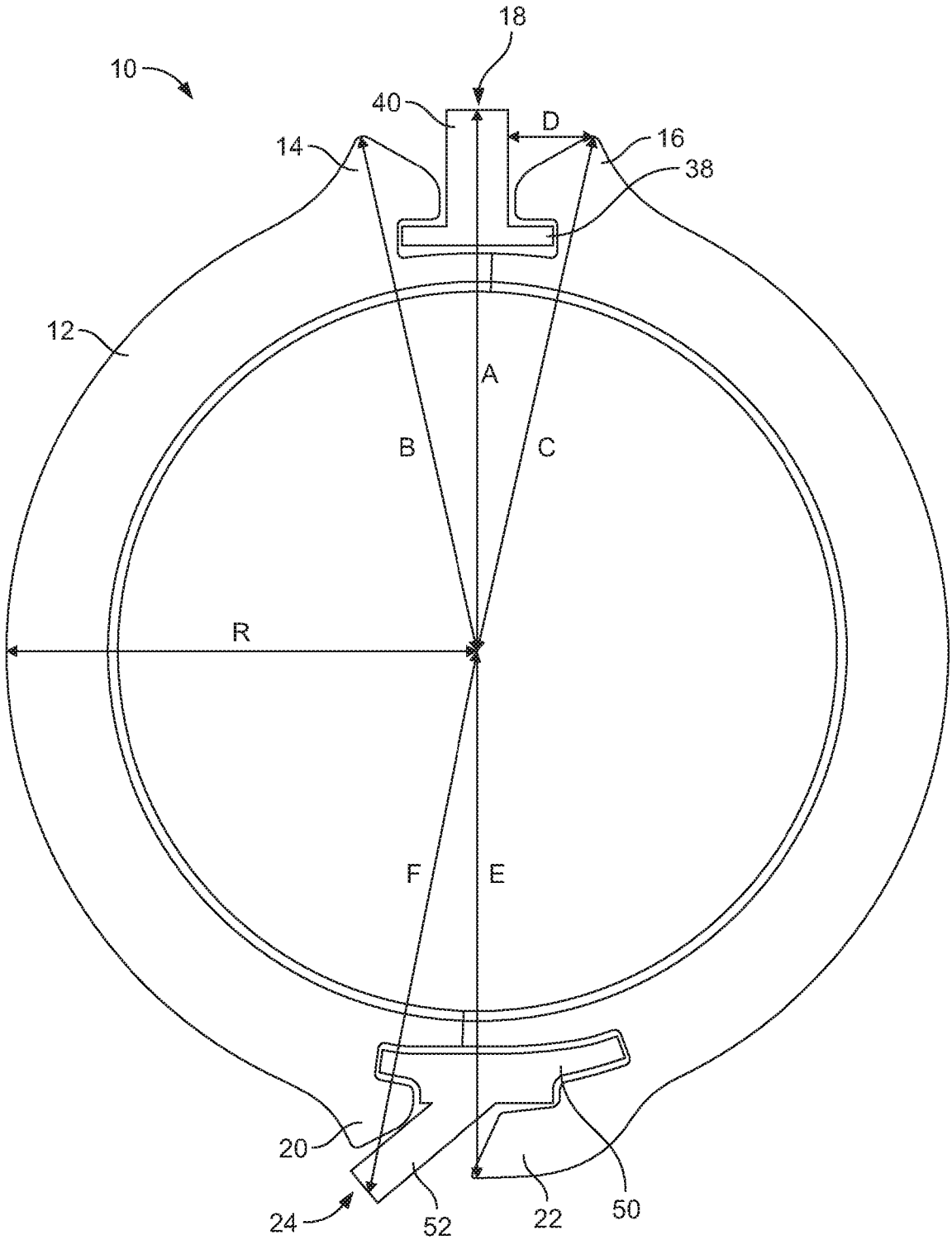
FIG. 3 is a schematic sectional view of the agitator of FIG. 1 taken transversely to a longitudinal axis of the agitator, with bristle strips inserted.

The main body 12 is substantially cylindrical in form, and is substantially hollow. The main body 12 has a first channel 26 for receiving the first bristle strip 18, and a second channel 28 for receiving the second bristle strip 24. Both the first 26 and second 28 channels have a substantially inverted T-shaped cross-section, substantially corresponding to the form of the first 18 and second 24 bristle strips, as can be seen in FIGS. 2 and 3. The first 26 and second 28 channels extend helically along the outer surface of the main body 12, with each of the first 26 and second 28 channels extending through 360° about the outer surface of the main body 12.

The first 14 and second 16 projections are located either side of the first channel 26, and have a generally triangular transverse cross-sectional shape. In the present embodiment, the first 14 and second 16 projections constitute regions of the main body 12 having an increased radius relative to the main body 12, such that the first 14 and second 16 projections are integrally formed with the main body 12. The main body 12, and the first 14 and second 16 projections are formed of acrylonitrile butadiene styrene (ABS), and are relatively rigid in nature, such that the first 14 and second 16 projections do not suffer excessive deformation upon contact with a surface to be cleaned in use.

The first 14 and second 16 projections each define respective tips 30, 32, and side walls 34, 36 of the first channel 26 extend to the base of the respective first 14 and second 16 projections. The first 14 and second 16 projections define walls having an angle of around 50° relative to nylon bristles 40 of the brushbar 10. The main body 12 has a radius R of around 25 mm, whilst the radius B, C in the region of the first 14 and second 16 projections at the tips 30, 32 is around 28 mm. The first 14 and second 16 projections are helical in form, and follow the shape of the first channel 26 along substantially the entire extent of the first channel 26.

The first bristle strip 18 comprises a bristle base 38 and a plurality of tufts of bristles 40 woven to the bristle base 38. The bristle base 38 is elongate and planar in form, with the plurality of tufts of bristles 40 upstanding therefrom. The bristles 40 are formed of nylon, and have sufficient strength to agitate debris located upon a surface to be cleaned in use, whilst still having sufficient flexibility to resiliently deform relative to the bristle base 38. In a presently preferred embodiment, the bristles 40 have a height of around 7 mm from the bristle base 38.

The first 20 and second 22 raised portions also constitute regions of the main body 12 having an increased radius relative to the main body 12, such that the first 20 and second 22 raised portions are integrally formed with the main body 12. The first 20 and second 22 raised portions define asymmetric peaks 42, 44, in contrast to the generally symmetrical angular tips of the first 14 and second 16 projections, although it is also envisaged that the first 20 and second 22 raised portions may have substantially the same form as the first 14 and second 16 projections. The main body 12 has a radius R of around 25 mm, whilst the radius E in the region of the first 20 and second 22 raised portions at the peaks 42, 44 is around 27 mm. The first 20 and second 22 raised portions are helical in form, and follow the shape of the second channel 28 along substantially the entire extent of the second channel 28.

The second bristle strip 24 comprises a bristle base 50 and a plurality of tufts of bristles 52 woven to the bristle base 50. The bristle base 50 is elongate and planar in form, with the plurality of tufts of bristles 52 upstanding therefrom. The bristles 52 are formed of carbon fibre, and hence are relatively softer than the nylon bristles 40. In a presently preferred embodiment, the bristles 52 have a height of around 12 mm from the bristle base 50. The use of carbon fibre bristles 52 is unlikely to have a negative impact with regard to debris wrapping around the brushbar 10 in use, as the soft nature of the bristles 52 means that debris is typically not entangled by the bristles 52, and hence cannot wrap around the brushbar 10.

The first 18 and second 24 bristle strips are slidably inserted within the respective first 26 and second channels 28, such that the bristles 40, 52 are upstanding from their respective channels 26, 28. In an undeformed position, for example a position in which the bristles 40, 52 do not contact a surface to be cleaned and are not subjected to external forces, tips of the nylon bristles 40 define a radius A of around 29 mm from a central longitudinal axis of the brushbar 10, whilst tips of the carbon fibre bristles 52 define a radius F of around 33 mm from the central longitudinal axis of the brushbar 10. Furthermore, the nylon bristles 40 are spaced from the tips 30, 32 of the first 14 and second 16 projections by a distance D of around 3 mm in a generally circumferential direction.

Thus it can be seen that the tips of the nylon bristles 40 define a greater radius than the tips 30, 32 of the first 14 and second 16 projections in a first configuration, i.e., in an undeformed position, such that the tips of the nylon bristles 40 extend past the tips 30, 32 of the first 14 and second 16 projections. This can be seen most clearly in FIG. 3, where the radius of the tips of the nylon bristles 40 is denoted by distance A, the radius of the tip 30 of the first projection 14 is denoted by distance B, and the radius of the tip 32 of the second projection 16 is denoted by distance C. The spacing of the nylon bristles 40 from the tips 30, 32 of the first 14 and second 16 projections in a substantially circumferential direction is denoted by distance D in FIG. 3.

Figure 4:
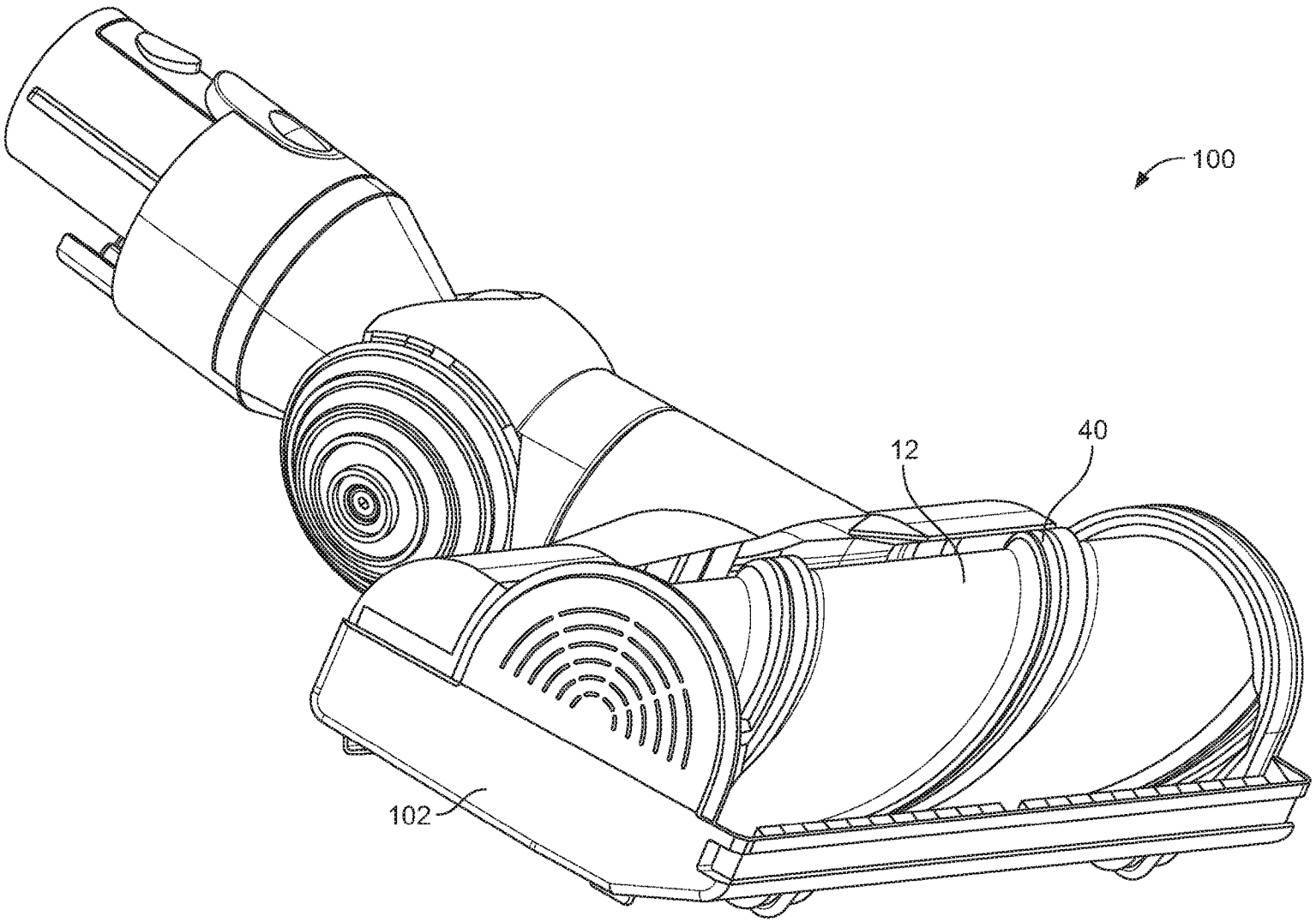
FIG. 4 is a perspective view of a cleaner head comprising the agitator of FIG. 1, with an upper housing portion of the cleaner head removed.
Figure 5:
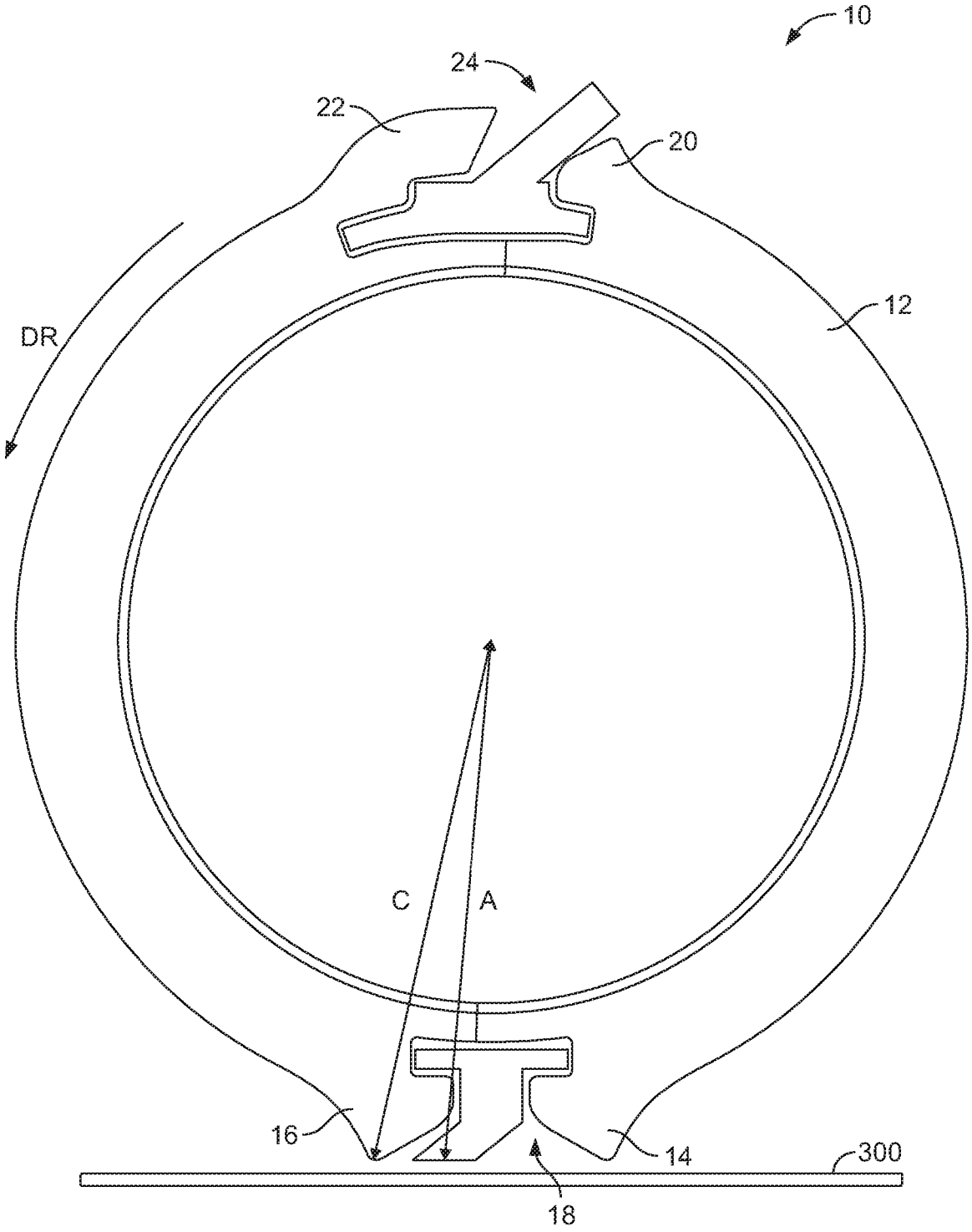
FIG. 5 is a schematic sectional view of the agitator of FIG. 1 taken transversely to a longitudinal axis of the agitator, with the agitator in contact with a surface to be cleaned.
Figure 6:
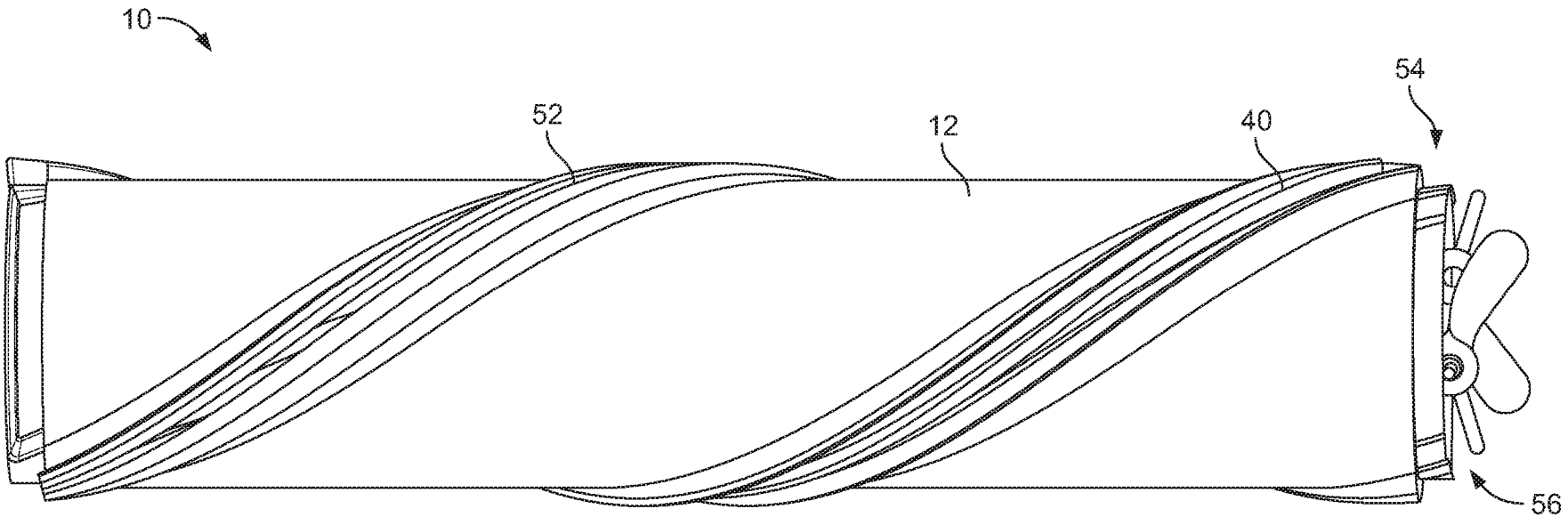
FIG. 6 is a front view of the agitator of FIG. 1 in combination with a debris removal mechanism.

During use, the brushbar 10 is rotatably mounted within a housing 102 of a cleaner head 100 of a vacuum cleaner, as seen in FIG. 4. The cleaner head 100 has a dirty air inlet and a dirty air outlet, such that dirty air is able to flow through the cleaner head 100 in use. The brushbar 10 rotates within the cleaner head 100, for example as a result of being driven by a motor housed within the main body 12, such that the nylon bristles 40 contact a surface to be cleaned 300. As the nylon bristles 40 contact the surface to be cleaned 300, the nylon bristles 40 are able to deform as a result of their flexibility and the spacing between the bristles 40 and the tips 30, 32 of the first 14 and second 16 projections. When the nylon bristles 40 reach a second configuration, i.e., a position of maximum deformation, the tips of the bristles are located at or below the tips 30, 32 of the first 14 and second 16 projections. Such a configuration is shown in FIG. 5 where the tips of the bristles 40 are sub-flush relative to the tips 30, 32 of the first 14 and second 16 projections.

Thus it can be seen that the tips of the nylon bristles 40 define a smaller radius than the tips 30, 32 of the first 14 and second 16 projections in a second configuration, i.e., in a deformed position, such that the tips of the nylon bristles 40 are at, or sub-flush relative to, the tips 30, 32 of the first 14 and second 16 projections. This second configuration has been found to have particularly advantageous effects in preventing wrapping of debris, for example hair or thread or the like, around the brushbar 10.

In particular, entanglement of debris with bristles can lead to debris wrapping around the brushbar 10 in use, and bristles are typically more densely packed, and hence more prone to entangle debris, at the base thereof. As the nylon bristles 40 have a second configuration in which the tips of the nylon bristles 40 are at, or sub-flush relative to, the tips 30, 32 of the first 14 and second 16 projections, a lower proportion, for example none, of the length of the nylon bristles 40 may be exposed past the tips 30, 32 in the second configuration, and hence debris may be prevented from migrating toward the bristle base 38 of the nylon bristles 40. Furthermore, debris which would typically become entangled in the nylon bristles 40, for example at the bristle base 38 of the bristles 40, may be contacted by the projections 14, 16 and prevented from reaching the bristle base 38 of the bristles 40, or moved out of contact with the bristles 40, for example outwardly to the level of the tips 30, 32 of the projections 14, 16 or to a less densely packed region of bristles 40, and may thereby prevent such entanglement from occurring. Engagement between the tips 30, 32 of the projections 14, 16 and the surface to be cleaned 300 may move debris outwardly through the bristles 40 to a region where the bristle density is insufficient to trap debris. Hence debris may not necessarily reach the level of the tips 30, 32 of the projections 14, 16, but may still be prevented from becoming entangled in the bristles 40 in use.

In addition to preventing debris from wrapping around the brushbar 10, the first 14 and second 16 projections may also act to move debris along the brushbar 10 in use. For example, the helical nature of the first 14 and second 16 projections may result in staged engagement between the projections 14, 16, debris, and the surface to be cleaned 300, and this may act to move debris along the brushbar 10.

To this end, the brushbar 10 also comprises a debris collection channel 54 formed at an end of the brushbar 10. In use, the interaction between the brushbar 10 and the surface to be cleaned 300 moves debris along the length of the brushbar 10, such that debris is collected within the debris collection channel 54. A debris removal mechanism 56 may be located at the debris collection channel 54 for automatic removal of debris, or the brushbar 10 may be removable from the cleaner head 100 such that a user can manually remove debris from the debris collection channel 54. In the embodiment shown in FIG. 6, it will be recognised that the debris removal mechanism 56 defines the debris collection channel 54, in that the debris removal mechanism 56 comprises a pair of scissors which can be selectively opened and closed to define the debris collection channel 54.

Figure 7:
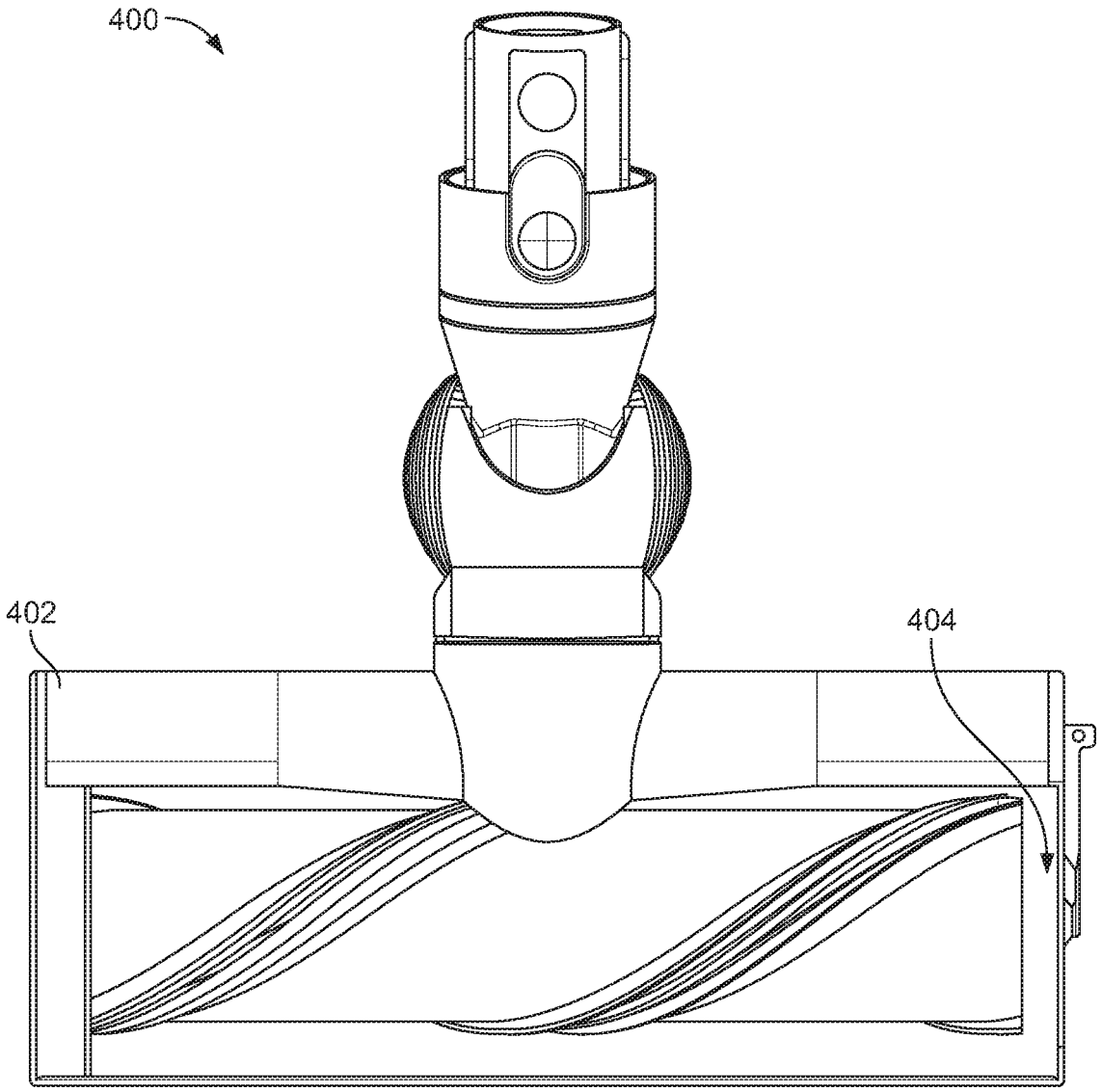
FIG. 7 is an upper view of an alternative cleaner head comprising the agitator of FIG. 1, with an upper housing portion of the cleaner head removed.

An alternative form of a cleaner head 400 is shown schematically in FIG. 7. The cleaner head 400 is substantially the same as the cleaner head 100, and comprises the same brushbar 10, but differs in that the brushbar 10 is cantilevered within the cleaner head 400. In this regard, only one end of the brushbar 10 is mounted to a housing 402 of the cleaner head 400, such that there is a free end 404 of the brushbar 10 within the housing 402. In such an embodiment, the brushbar 10 may act to migrate debris along the brushbar 10 toward the free end 404, such that debris is able to fall off the free end 404 and become re-entrained within the air flow through the cleaner head 400.

Figure 8:
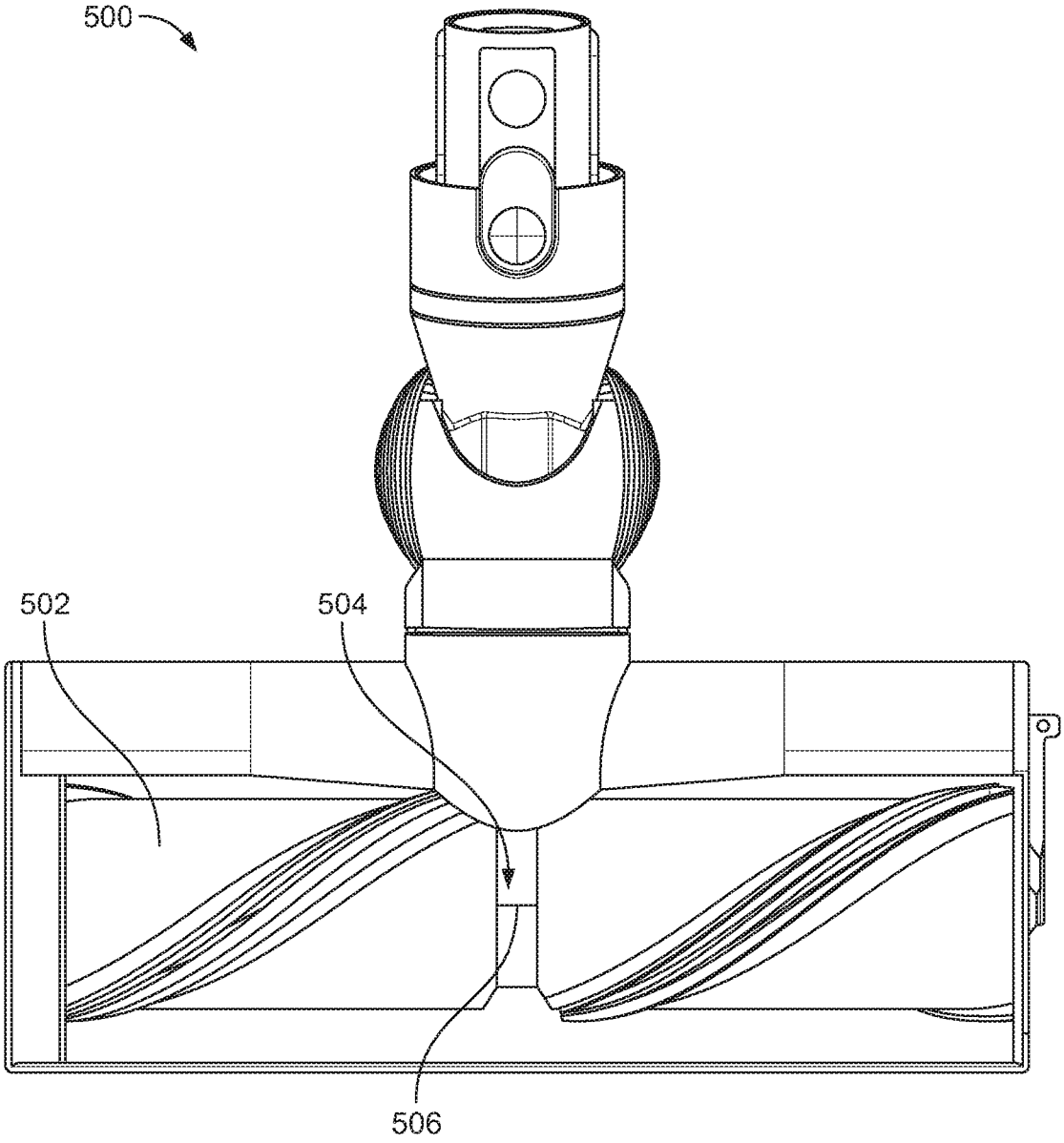
FIG. 8 is an upper view of a further alternative cleaner head comprising a further alternative agitator, with an upper housing portion of the cleaner head removed.

An alternative cleaner head 500 is shown in FIG. 8. The cleaner head 500 is substantially the same as the cleaner head 100, and differs only in the form of the brushbar 502. The brushbar 502 has substantially the same structure as the brushbar 10 previously described, but also has a further debris collection channel 504 located centrally along the brushbar 502. This may be beneficial as debris may have to travel a reduced distance along the brushbar 502, and hence there is a reduced risk of debris wrapping around the brushbar 502 as it travels along the brushbar 502 in use. The further debris collection channel 504 is a region of the brushbar 502 that has a reduced diameter relative to the remainder of the brushbar 502, and the further debris collection channel 504 extends about substantially the entire circumference of the brushbar 502. A debris removal slot 506 extends transversely across the further debris collection channel 504, and enables insertion of a debris removal member, for example a blade or a pair of scissors, to remove debris from the further debris collection channel 504.

Figure 9:
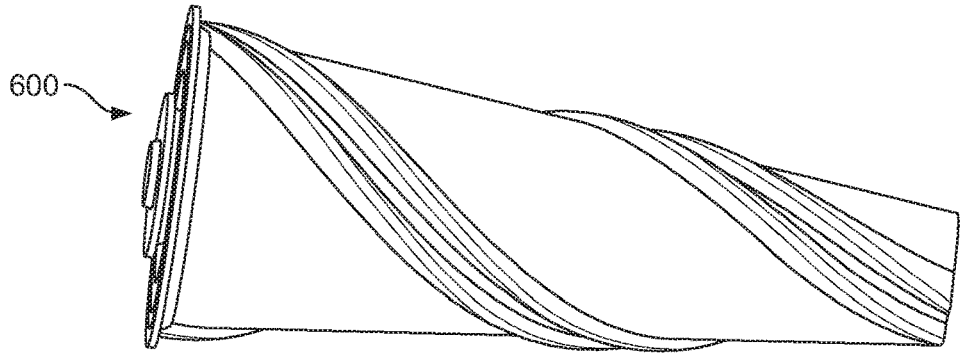
FIG. 9 is a schematic view of an alternative agitator according to the present invention.

A further alternative brushbar 600 according to the present invention is shown in FIG. 9, The brushbar 600 is substantially the same as the brushbar 10, and differs in that the brushbar 600 is tapered along its length, such that the hrushhar 600 guides debris towards the debris collection channel 54 in use. This may be beneficial as the brushbar 600 may further guide debris toward the debris collection channel 54 in use. The taper angle at the brushbar 600 may be greater than 5°, or indeed greater than 10°, and at least sufficient to guide debris along the brushbar 10 and toward the debris collection channel 54 in use. A cleaner head is also envisaged wherein the brushbar 600 is cantilevered within the cleaner head, such that the cleaner head resembles the cleaner head 400 discussed previously. The brushbar 600 appears frustoconical in form. An offset drive may be used to ensure that a portion of the brushbar 600 always lies parallel to a surface to be cleaned in use.

Figure 10:
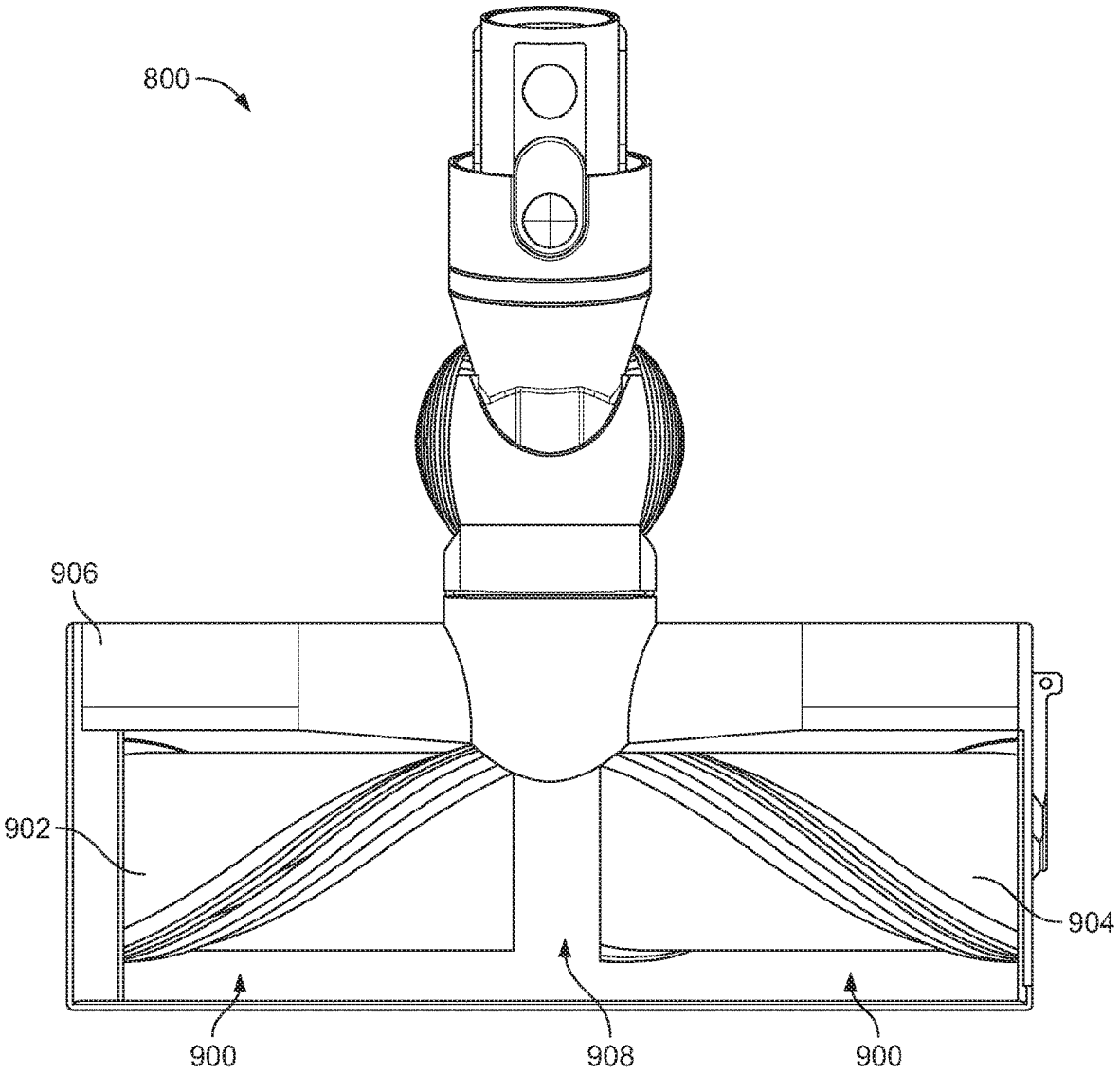
FIG. 10 is an upper view of a further alternative cleaner head comprising a further alternative agitator, with an upper housing portion of the cleaner head removed.

A further alternative cleaner head 800 is shown in FIG. 10. The cleaner head 800 comprises a brushbar 900 having first 902 and second 904 brushbar portions, each of which is cantilevered within the housing 906 of the cleaner head 800, such that a gap 908 is formed between the first 902 and second 904 brushbar portions. Each of the first 902 and second 904 brushbar portions has substantially the same form as the brushbar 10 according to the first aspect of the present invention, only reduced in size, such that the first 902 and second 904 brushbar portions migrate debris toward the gap 908 in use, thereby allowing debris to be re-entrained in air flow through the cleaner head 800.

Figure 11:
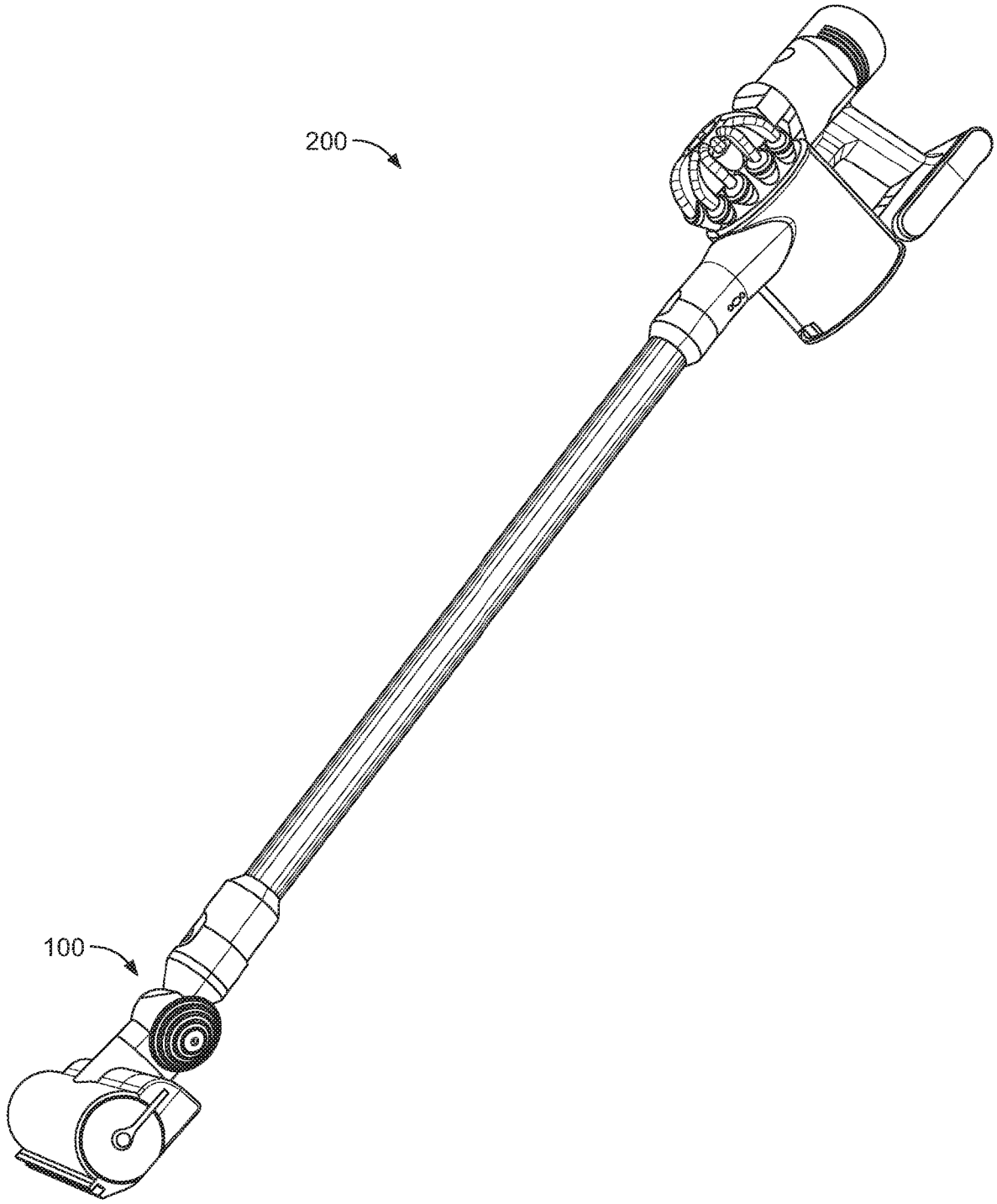
FIG. 11 is a perspective view of a vacuum cleaner according to the present invention.

A vacuum cleaner 200 comprising a cleaner head 100 according to the present invention is shown schematically in FIG. 11.

Further alternative cleaner heads according to the present invention are shown in FIGS. 12A to 13D.

Figure 12A:
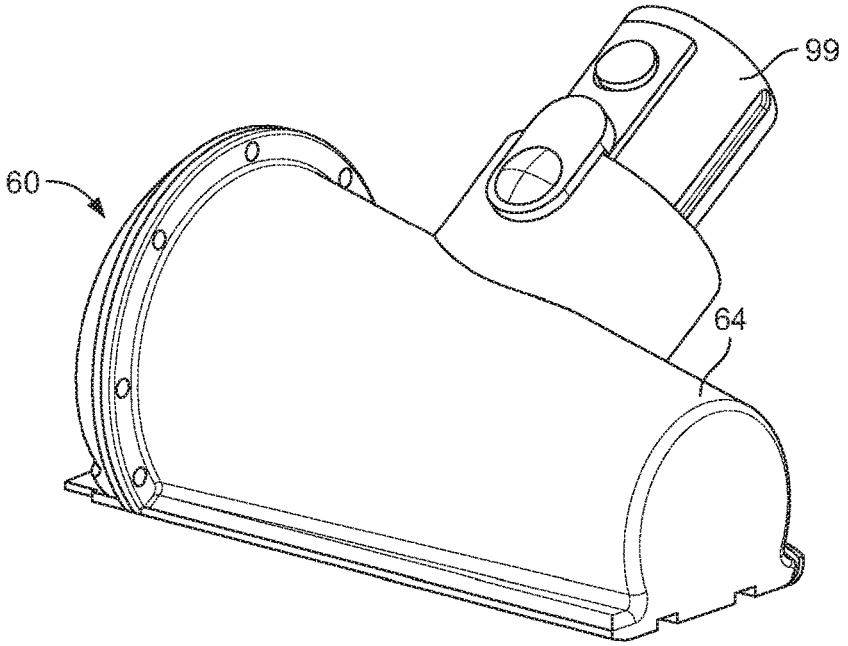
FIG. 12A is a perspective view of a further embodiment of the cleaner head of the present invention.
Figure 12B:
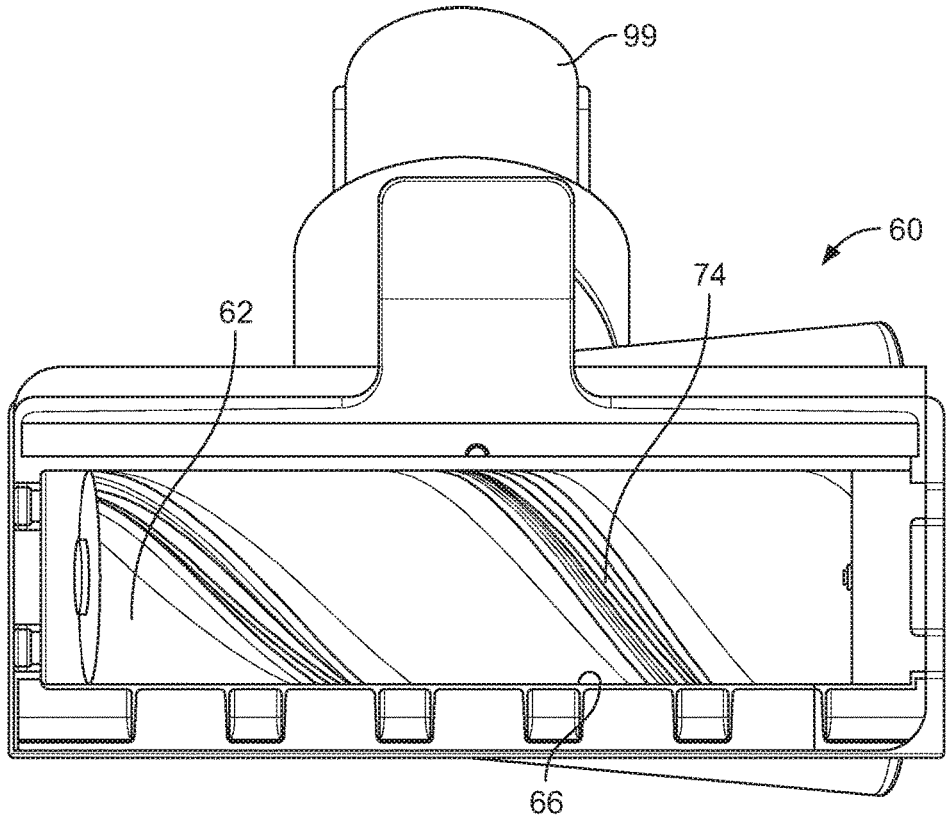
FIG. 12B is an underside view of the cleaner head shown in FIG. 12A.
Figure 13A:
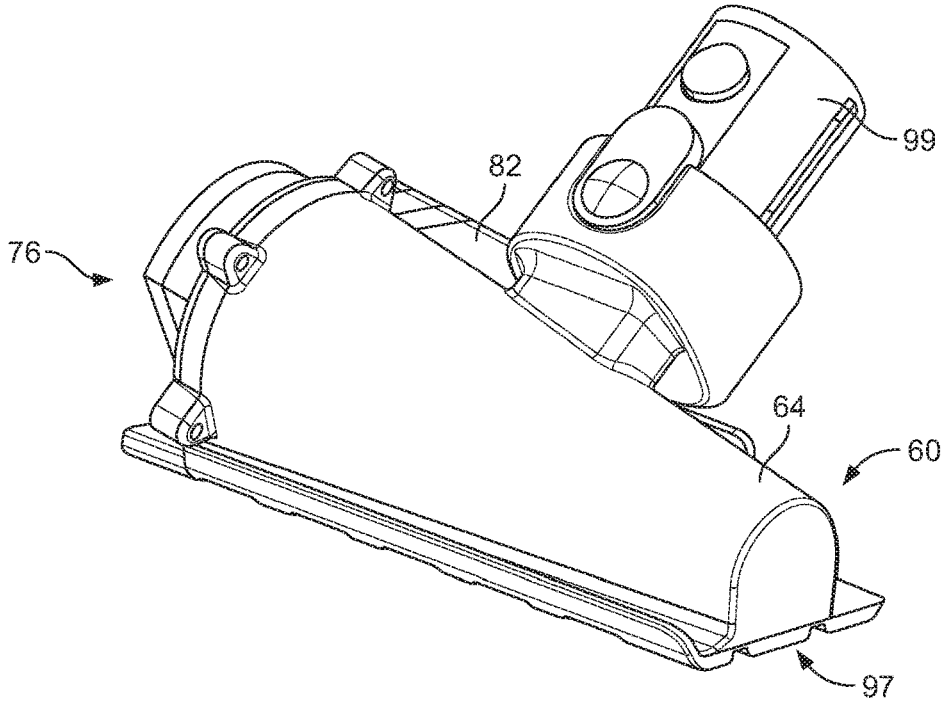
FIG. 13A is a perspective view of a further embodiment of the cleaner head of the present invention.
Figure 13B:
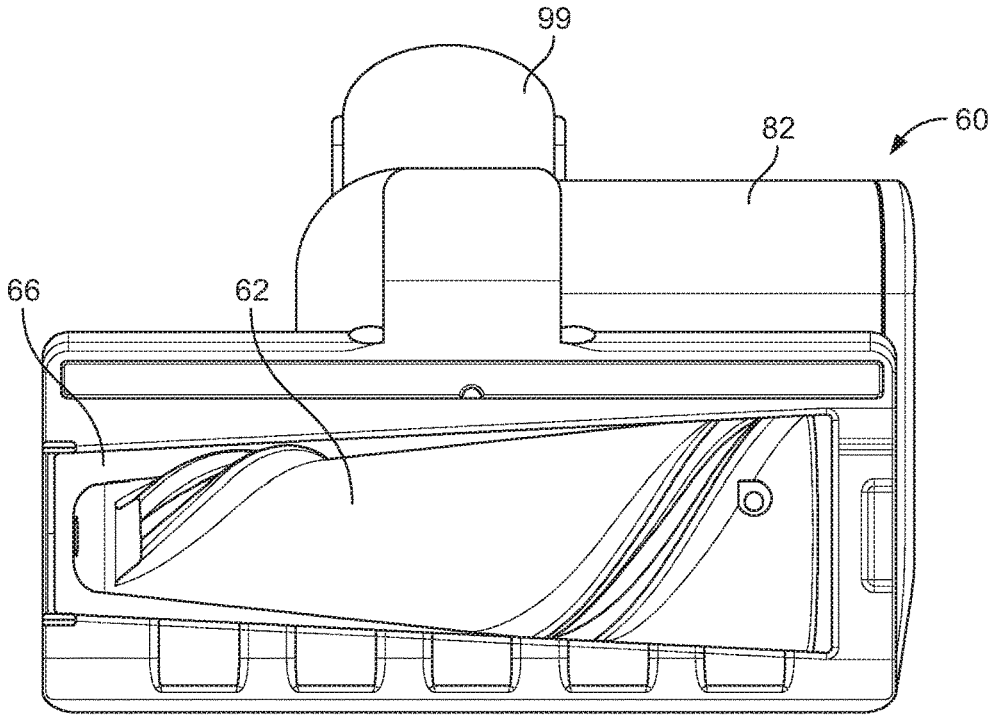
FIG. 13B is an underside view of the cleaner head shown in FIG. 13*a*

In these alternative embodiments the cleaner head 60 can be seen to include a single agitator 62 which is conical in shape. The agitator 62 is rotatably mounted within a housing 64 which is also substantially conical in shape. The housing 64 covers at least the upper and side portions of the agitator 62. The housing 64 also has an opening 66 through which a portion of the agitator 62 can project. During use of the cleaner head 60 the projecting portion of the agitator 62 will be able to contact and agitate a surface to be cleaned. The opening 66 may conform in outline to the taper of the agitator 62. This is shown in FIG. 13B. Alternatively the opening 66 may be rectangular as shown in FIG. 12B. The agitator 62 may further comprise surface agitating means 74 in the form of bristle tufts, bristle strips or a surface conforming material, for example felt or fleece.

The agitator 62 is arranged transversely within the housing 64 such that it is perpendicular to the direction of travel of the cleaner head 60 during use. It can be seen in the Figures that the agitator 62 has a main body 68 with an outer conical surface. The lowermost surface 70 of the conical surface is parallel with a flat supporting surface 72 when the cleaner head 60 is in use. This means that any bristles 74 on the agitator 62 can be of a uniform length all along the agitator 62. This is achieved by having the axis of rotation (X) of the agitator 62 inclined with respect to the flat supporting surface 72 on which the cleaner head 60 is supported during use. It can be seen that the agitator 62 extends transversely across substantially the full width of the housing 64.

In the embodiments shown in FIGS. 12A to 13D it can be seen that the agitator 62 is cantilevered to the housing 64 at its first end 76. Two different embodiments are shown in FIGS. 12C and 13C. In 12*c* the agitator 62 is driven by a motor 78 which is housed inside the agitator 62. In 13*c* the agitator is driven by a motor and drive belt 80. The motor (not shown) in this embodiment is housed in a motor housing 82 which forms part of the cleaner head housing 64 and is located next to the first end 76 of the agitator 62.

Figure 13C:
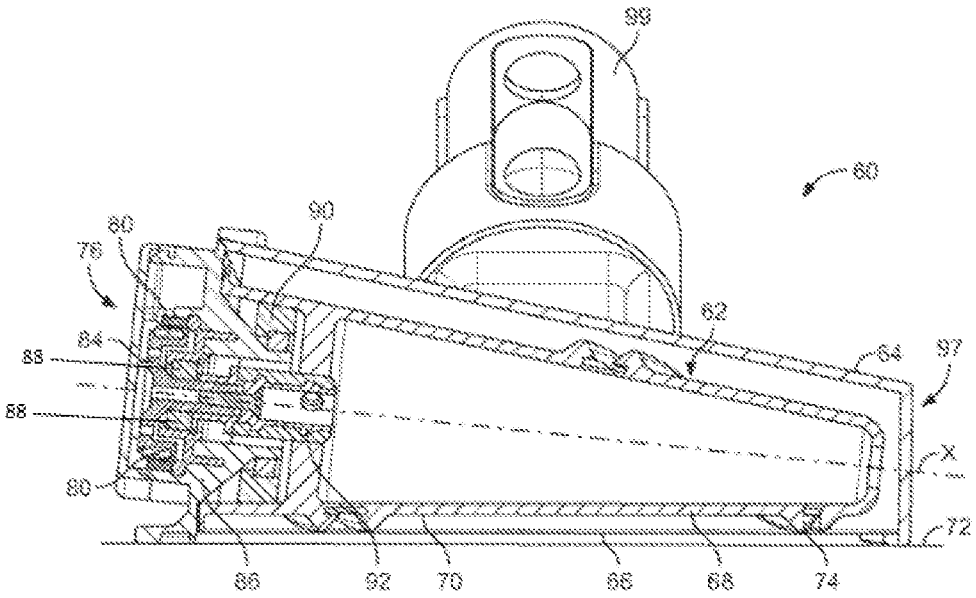
FIG. 13C shows a section through the cleaner head shown in FIGS. 13A and 13B.
Figure 13D:
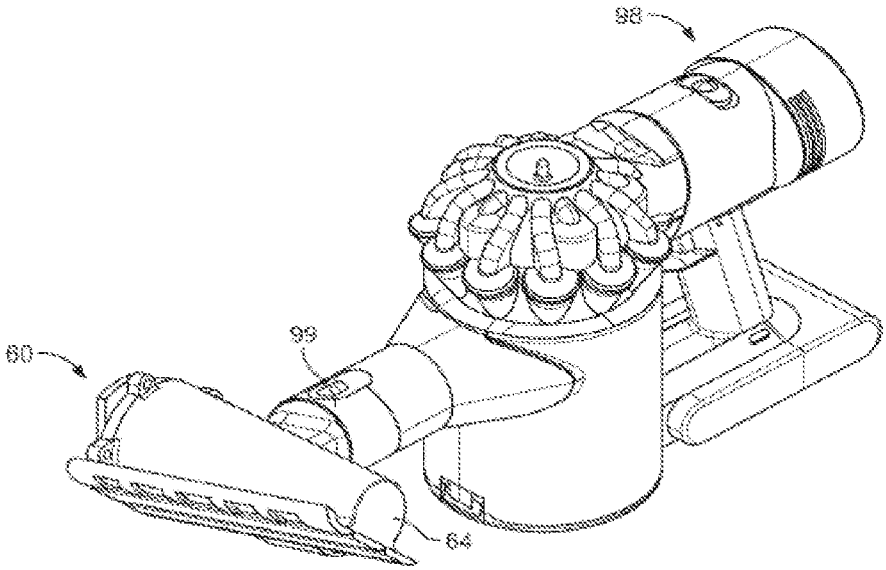
FIG. 13D is a perspective view of a vacuum cleaner according to the present invention.

In FIG. 13C it can be seen that the drive belt 80 and the belt drive system 84 are located at the first end 76 of the agitator 62. The cantilever support 86 is mounted to the belt drive system 84. The cantilever support projects 86 away from the belt drive system 84 and provides a mount onto which the agitator 62 is rotatably mounted via bearings 88 and agitator fixings 90. A drive dog 92 projects through the cantilever support 86 and is connected to the agitator 62 for driving rotation.

Figure 12C:
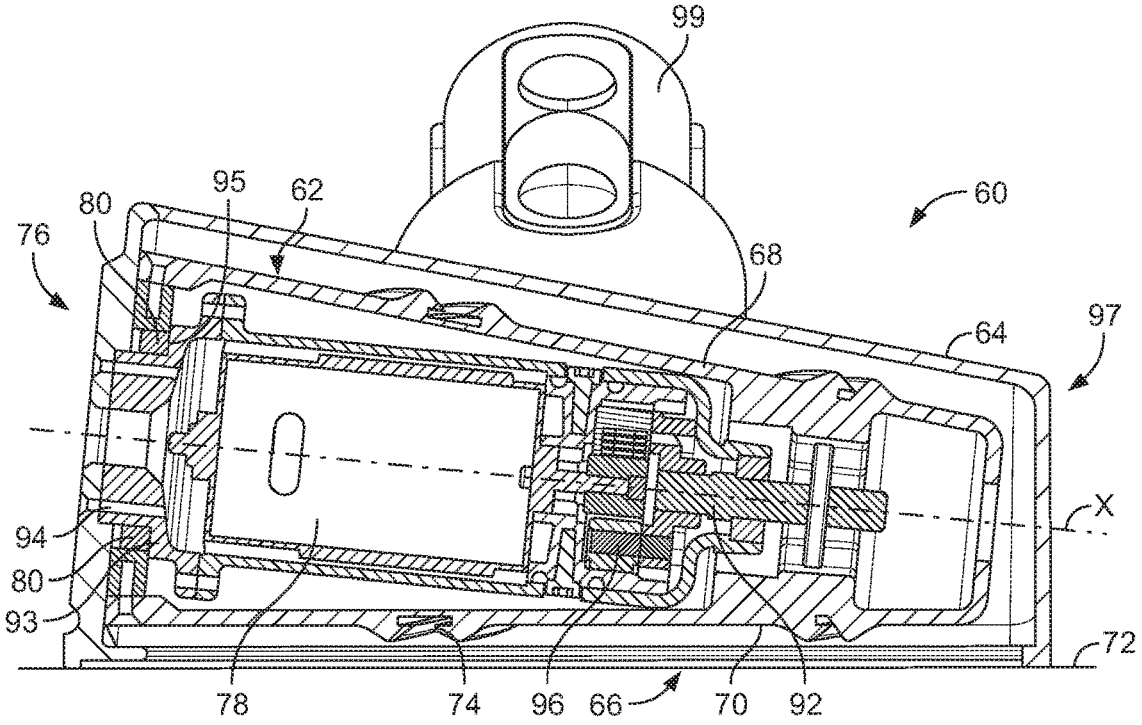
FIG. 12C shows a section through the cleaner head shown in FIGS. 12A and 12B.

In FIG. 12C it can be seen that a motor 78 is located inside the agitator 62. A motor mounting 93 is fixed to the housing 64 via any suitable means, for example screws 94. The motor mounting 93 also forms a housing for the motor 78. The motor mounting 93 forms a recessed channel 95 at the first end 76 of the agitator 62 into which bearings 88 are provided. These bearings 88 and agitator fixings 90 which are fixed to the first end of the agitator 62 form the cantilevered mounting in this embodiment. A gear box 96 is also proved within the agitator 62. The drive dog 92 projects from the gear box and is connected to the agitator 62 for driving rotation.

Figure 12D:
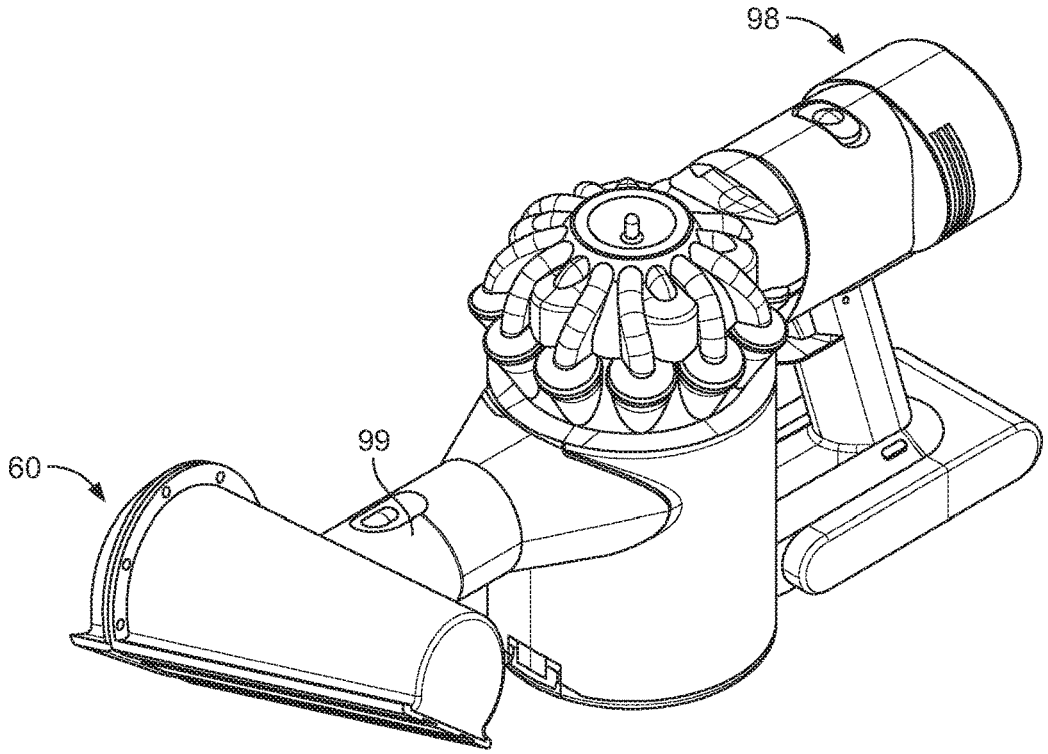
FIG. 12D is a perspective view of a vacuum cleaner according to the present invention.

The second end 97 is not mounted to the housing 64 and therefore any debris that gets tangled on the agitator 62 during use of the cleaner head 60 can fall of the second end 97 and can be sucked up into a vacuum cleaner 98 to which the cleaner head 60 is attached. FIGS. 12D and 13C show these embodiments attached to a vacuum cleaner 98.

The housing 64 further comprises a neck 99 suitable for connection to a vacuum cleaner 98. The neck 99 is arranged such that it projects rearwardly from the housing 64 at a point between the first 76 and second 97 ends of the agitator 62. In the embodiments shown in FIGS. 12A to 13D the neck 99 projects from the housing 64 at a mid-point between the first 76 and second 97 ends of the agitator 62.

The invention claimed is:

1. A cleaner head for a vacuum cleaner, the cleaner head comprising:

a single agitator rotatably mounted within a housing, the agitator being arranged transversely within the housing such that the agitator is perpendicular to a direction of travel of the cleaner head during use, the agitator being frustoconical such that a first end has a larger diameter than a second end, wherein the first end of the agitator is cantilevered to the housing, and wherein a neck suitable for connection to the vacuum cleaner projects from the housing at a point between the first and second ends of the agitator.

2. The cleaner head of claim 1, wherein the agitator has a main body with an outer conical surface, and a lowermost portion of the conical surface is parallel with a flat supporting surface when the cleaner head is in use.

3. The cleaner head of claim 1, wherein an axis of rotation of the agitator is inclined with respect to a flat supporting surface on which the cleaner head is supported during use.

4. The cleaner head of claim 1, wherein the agitator extends transversely across less than a full width of the housing.

5. The cleaner head of claim 1, where the housing has a lower opening and the lower opening conforms in outline to a taper of the agitator.

6. The cleaner head of claim 1, wherein the agitator further comprises bristle tufts, bristle strips or a surface conforming material.

7. The cleaner head of claim 1, wherein the agitator is driven by a belt from a motor located outside of the agitator.

8. The cleaner head of claim 1, wherein a motor for driving rotation of the agitator is located inside the agitator.

9. The cleaner head of claim 1, wherein the housing is frustoconical.

10. The cleaner head of claim 1, wherein the neck projects from the housing at a mid-point between the first and second ends of the agitator.

11. The vacuum cleaner comprising the cleaner head of claim 1.

12. The cleaner head of claim 1, wherein the agitator is rotatably mounted to a support configured to be mounted to a belt drive system for driving the agitator.

13. The cleaner head of claim 1, wherein the agitator comprises a main body having a channel, wherein the channel is configured to receive a bristle strip, and wherein the main body comprises a first projection located on one side of the channel and a second projection located on the other side of the channel.

14. A cleaner head for a vacuum cleaner, the cleaner head comprising:

an agitator rotatably mounted within a housing by a support configured to be mounted to a belt drive system for driving the agitator, the agitator comprising a bristle strip, the agitator being arranged transversely within the housing such that the agitator is perpendicular to a direction of travel of the cleaner head during use, the agitator being frustoconical such that a first end has a larger diameter than a second end, wherein the agitator is cantilevered to the housing at the first end, and wherein a neck suitable for connection to the vacuum cleaner projects from the housing at a point between the first and second ends of the agitator.

* * * * *